US005664707A

United States Patent [19]

Spector

[11] Patent Number: 5,664,707

[45] Date of Patent: Sep. 9, 1997

[54] BEAD INSTALLING TOOL AND METHOD OF USE

[76] Inventor: Paul Spector, 4600 Dietz Way, Suite 100, Fair Oaks, Calif. 95628

[21] Appl. No.: 506,072

[22] Filed: Jul. 24, 1995

[51] Int. Cl.[6] ..... A41H 43/00; B23P 19/04

[52] U.S. Cl. ..... 223/48; 223/99; 29/241; 29/433

[58] Field of Search ..... 223/1, 48, 44, 223/104, 99; 29/241, 433; 132/212, 200, 201

[56] References Cited

U.S. PATENT DOCUMENTS

| | | | |
|---|---|---|---|
| 608,926 | 8/1898 | Summers | 223/104 |
| 3,133,345 | 5/1964 | Shaw | 29/433 |
| 3,227,121 | 1/1966 | Speetgers et al. | 112/222 |
| 3,339,438 | 9/1967 | Stover | 223/104 |
| 3,404,707 | 10/1968 | Feld | 223/99 |
| 3,545,069 | 12/1970 | Krieger | 29/433 |
| 4,102,478 | 7/1978 | Samoilou | 223/99 |
| 4,315,362 | 2/1982 | Pigford et al. | 29/241 |
| 4,779,616 | 10/1988 | Johnson | 223/99 |
| 5,456,271 | 10/1995 | Legette | 132/212 |
| 5,558,105 | 9/1996 | Rosenwinkel et al. | 132/212 |

FOREIGN PATENT DOCUMENTS

| | | | |
|---|---|---|---|
| 767429 | 7/1934 | France | 223/48 |

*Primary Examiner*—Bibhu Mohanty
*Attorney, Agent, or Firm*—Terrance L. Siemens

[57] ABSTRACT

A tool for installing perforated beads on a strand of fibers, such as a strand of hair. The tool comprises a rod terminating in a closed loop at one end, and having a removable cap at the other end. When the cap is removed, perforated beads are sequentially loaded onto the rod. The cap is replaced, thus retaining the beads between the cap and the loop. The strand of fibers is passed through the loop. The loop is resilient, and is manually compressed to accommodate passage of the beads as the beads are pushed from the rod onto the strand of fibers. The tool is then disengaged from the strand. The beads may be secured in place by crimping one or more beads, or by applying a cement to the strand, or both. The cement may either act by adhering a bead to the strand, or by increasing the diameter of the strand so that it no longer passes through the bead.

5 Claims, 2 Drawing Sheets

BEAD INSTALLING TOOL AND METHOD OF USE

BACKGROUND OF THE INVENTION

1. Field of the Invention

The present invention relates to a tool for installing beads on fibers, and more particularly for installing beads having a throughbore onto the hair of a person for aesthetic purposes. The tool comprises a shaft for storing beads, and a loop for engaging the hair.

2. Description of the Prior Art

Adornment of people's hair has taken many forms, and one of these is a hair styling practice in which beads are slipped over strands of hair. The beads are typically annular in configuration, but may be any configuration provided there is a bore through the bead through which the hair strand is inserted.

Beads have been placed in people's hair by all sorts of methods, including manually and by a cumbersome process employing needle and thread. An implement which is generally intended to replace needle and thread is shown in U.S. Pat. No. 4,307,908, issued to Honora A. Donaldson on Dec. 29, 1981. The tool includes a tubular handle having two loops projecting therefrom, one resilient closed loop at each end.

Only one resilient closed loop is actually employed in installing beads, the other serving as a stop preventing the beads from slipping from the handle. A bead or several beads are placed over the handle and stored thereon after compressing a resilient closed loop. A strand of braided hair is then passed through a loop. The handle is pulled away from the strand of hair, which strand is thereby drawn so as to pass through the opening of the bead or beads. The bead or beads now encircle the strand of hair. If desired, the operation may be repeated to install additional beads on the strand.

The Donaldson invention departs from that of the present invention in both structure and method of use. By contrast with the Donaldson apparatus, wherein a loop is manually compressed in order to slip a supply of beads onto the handle, the present invention requires no such manipulation. In the present invention, a handle frictionally disengages from a rod or shaft which passes through stored beads, so that beads may be loaded onto the rod or shaft. After loading, the handle is reinstalled, and serves to retain the beads on the tool.

Neither the above invention and patent, nor other patents and inventions of the prior art, taken either singly or in combination, is seen to describe the instant invention as claimed.

SUMMARY OF THE INVENTION

The present invention comprises apparatus and method for installing perforated beads onto a strand of fibers. A principal application of the invention is to adorn the hair of a person, when the hair is arranged in strands.

The invention improves on the Donaldson device by eliminating the effort to push beads onto a member which must be simultaneously compressed. Instead, in the present invention, the beads are placed onto a rigid rod. There is no member which need be compressed or otherwise manipulated to overcome its resistance to passage of the beads onto a rigid rod.

This is enabled by providing a cap which is removed from the rigid rod to perform initial loading of beads onto the rod, and which cap is replaced to retain the beads on the rod.

The apparatus also has a compressible loop for accepting a strand of fibers, such as human hair. The beads are pushed onto the strand, and the apparatus is then disengaged from the hair.

The novel apparatus is inexpensive to fabricate. An advantage over the Donaldson device is that the present invention has only one loop to fabricate, while providing the same ability to engage a strand of fibers for installing beads. The cap is an inexpensive component having an opening which frictionally engages the rod. Therefore, no great degree of precision is required in fabricating the cap.

To assist in securing beads in place on the strand, either or both of two further steps may be employed. One option is to crimp the beads, which requires that the beads be deformable but not elastic, so that they retain the new configuration.

A second option is to apply a cement to the hair strand below the last bead. This step operates by adhering the last bead to the strand, by increasing the diameter of the strand so that the end thereof can no longer pass through the perforation in the bead, or both.

Accordingly, it is a principal object of the invention to expedite placing of perforated beads on a strand of fibers.

It is another object of the invention to provide an apparatus which expeditiously accepts loading of beads thereon.

It is a further object of the invention to secure beads on the strand of fibers.

Still another object of the invention is to provide beads which can be crimped in order to remain on the strand of fibers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
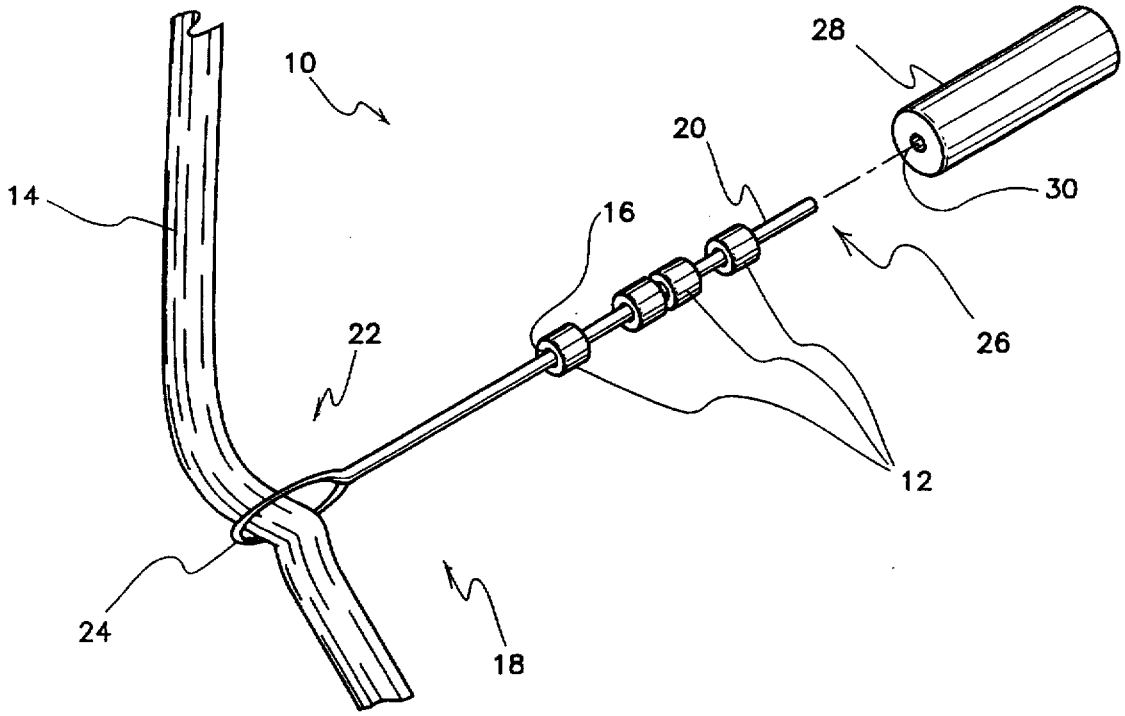
FIG. 1 is an environmental, partially exploded, perspective view of the invention.

Turning now to FIG. 1 of the drawings, the novel tool 10 is shown in the preliminary stages of installing perforated beads 12 on a strand 14 of fibers. Beads 10 have a throughbore 16 through which strand 14 passes after installation. Beads 10 are shown as being generally cylindrical and annular. However, they may be of any external configuration, as long as throughbore 16 is present. Beads 10 also encompass all manners of baubles and small adornments, such as charms, which have structure apart from that required merely to encircle hair.

Tool 10 has two separable members. One member 18 comprises a rod 20 having at its proximal end 22 a resilient, closed loop 24. Loop 24 encircles strand 14 during installation, and elastically deforms to allow beads 12 to slip over loop 24. Normally, loop 24 expands by its inherent resilience, so that beads 12 cannot inadvertently slip off member 18 at end 22.

Distal end 26 of rod 20 is free, in the sense of having no attached structure. Beads 12 are slipped over end 26 to load tool 10. A cap 28 having a hole 30 is pushed onto rod 20 past end 26 when loading is completed. Cap 28 engages or fits closely to rod 20, so that it is retained by friction, but is manually removable and installable. With cap 28 in place on rod 20, beads are stored thereon and entrapped between loop 24 and cap 28.

Figure 2:
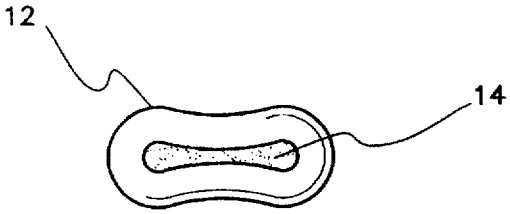
FIG. 2 is an end detail view of a bead crimped around a strand of fibers.

FIG. 2 shows a bead 12 which is made from a material which is deformable, and which retains its configuration after deforming. If fabricated from such a material, such as most metals, bead 12 is susceptible to being crimped, this being illustrated in this Figure. Crimping is one method for securing a bead on its strand of fibers, so that this bead and any other beads also placed on the strand will not slip off.

Figure 3:
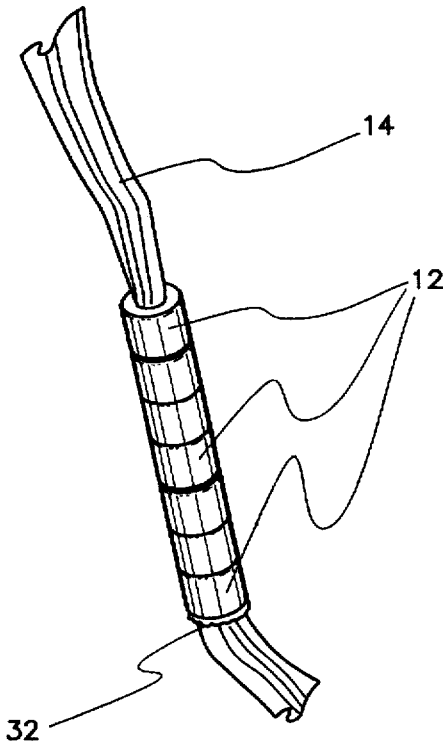
FIG. 3 is a side elevational detail view of cement applied to retain beads on a strand of fibers.

FIG. 3 illustrates a second method for securing a bead or succession of beads in place. Cement 32 is placed on strand 14 after all beads 12 have been installed thereon. Cement 12 is any suitable fluent material which hardens sufficiently to embed strand 14 therein. Alternatively, cement 12 is an adhesive which adheres to and joins strand 14 and a bead 12. One suitable material for providing a hardening cement is clear fingernail polish. Practitioners of the present invention will think of many more suitable materials.

Figure 4:
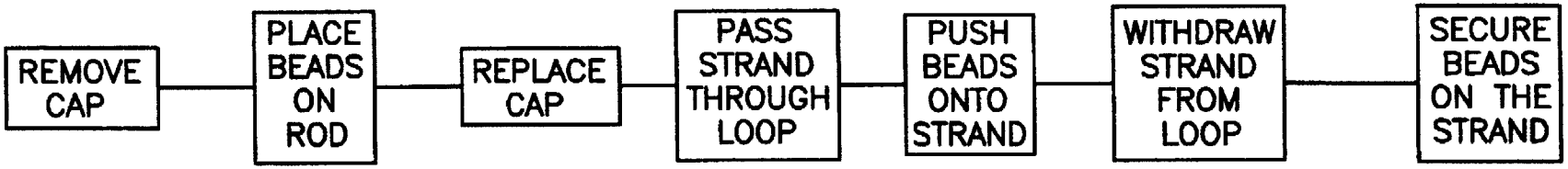
FIG. 4 is a block diagram summarizing steps of a method of installing beads on a strand of fibers by employing the novel apparatus.

The principal steps of a method for installing beads 12 onto a strand 14 of fibers while employing the novel tool 10 will be reviewed. The steps of the method are shown in FIG. 4, reading from left to right in this Figure, while reference numerals apply to FIG. 1. Starting with cap 28 removed from rod 20, beads 12 are slipped onto rod 20. Cap 28 is then secured to rod 20 by sliding cap 28 past end 26, onto rod 20. Tool 10 is now loaded, and ready to be placed on strand 14.

Strand 14 is passed through loop 24, and beads 12 are pushed over loop 24 and onto strand 14. Strand 14 is withdrawn from loop 24 by pulling tool 10 away from strand 14. It may be necessary to hold beads 12 temporarily with one hand while withdrawing tool 10.

Beads 12 are then secured in place on strand 14 by one or both of two methods, that of crimping the last bead 12 placed on strand 14, or that of applying cement 32.

Obviously, variations may be made in the apparatus and method set forth herein without departing from the spirit of the invention. For example, some of the steps of the method may be reordered. In another example, cap 28 may thread to rod 20, if desired.

Of course, the methods disclosed herein are equally applicable to hair whether braided or unbraided.

In a further step, hair may be passed not only through a bead, but reversed and passed through the same bead in the opposite direction, so that the hair forms a loop projecting from the bead. A bead may be suspended from the loop.

It is to be understood that the present invention is not limited to the embodiments described above, but encompasses any and all embodiments within the scope of the following claims.

I claim:

1. In combination a tool for storing perforated beads and installing perforated beads on a strand of fibers and perforated beads, said combination comprising:

a single rigid rod having proximal and distal ends, said rigid rod forming a collapsible resilient closed loop at said proximal end with said loop being normally in an expanded state where said loop will prevent passage of a bead perforation and being forcible into a collapsed state where said loop will permit easy passage of the bead perforation, and said distal end being free and sufficiently small to permit easy passage of the bead perforation; and a reattachable cap for covering said distal end of said rigid rod and being sufficiently sized to prevent passage through the bead perforation, and perforated beads placed over said distal end, stored on said rigid rod, and retained thereon by entrapment between said resilient closed loop in said expanded state and said reattachable cap.

2. A method of installing perforated beads on a strand of fibers by:

providing a tool having one end terminating in a resilient closed loop, and at the other end having a removably attachable cap;

placing perforated beads on the rigid rod;

securing the cap to the rod, thereby retaining the beads on the tool;

passing a strand of fibers through the closed loop of the tool; and pushing the beads onto the strand of fibers.

3. The method of installing perforated beads on a strand of fibers according to claim 2, comprising the further step of:

withdrawing the strand of fibers from the closed loop of the tool.

4. The method of installing perforated beads on a strand of fibers according to claim 2, comprising the further step of:

crimping the last bead placed on the strand of fibers.

5. The method of installing perforated beads on a strand of fibers according to claim 2, comprising the further step of:

applying cement to retain a bead on the strand of fibers.

* * * * *